US006113070A

United States Patent [19]

Holzboog

[11] Patent Number: 6,113,070

[45] Date of Patent: Sep. 5, 2000

[54] AEROSOL VALVE ASSEMBLY AND METHOD OF MAKING AN AEROSOL CONTAINER

[75] Inventor: Walter Holzboog, Ballwin, Mo.

[73] Assignee: Delta Industries, Inc., St. Louis, Mo.

[21] Appl. No.: 09/209,105

[22] Filed: Dec. 10, 1998

[51] Int. Cl.[7] ..... F16K 31/00

[52] U.S. Cl. ..... 251/342; 251/347; 251/354; 222/402.24; 239/337; 239/579; 239/597

[58] Field of Search ..... 251/342, 347, 251/354; 222/402.24; 239/337, 597, 579

[56] References Cited

U.S. PATENT DOCUMENTS

| | | | |
|---|---|---|---|
| 3,180,374 | 4/1965 | Muller | 251/342 |
| 4,013,197 | 3/1977 | Ewald | 222/402.24 |
| 4,322,037 | 3/1982 | Heeb et al. | 222/402.24 |
| 4,442,959 | 4/1984 | Bon et al. | 222/402.24 |
| 4,522,318 | 6/1985 | Bon | 222/402.24 |
| 4,805,839 | 2/1989 | Malek | 239/337 |
| 4,824,075 | 4/1989 | Holzboog | 251/349 |
| 4,852,807 | 8/1989 | Stoody | 239/337 |
| 4,958,755 | 9/1990 | Gerstung | 222/402.23 |
| 5,014,887 | 5/1991 | Kopp | 222/402.1 |
| 5,263,616 | 11/1993 | Abplanalp | 222/402.13 |
| 5,335,832 | 8/1994 | Laforcade | 222/402.13 |
| 5,553,755 | 9/1996 | Bonewald et al. | 222/402.21 |

*Primary Examiner*—A. Michael Chambers
*Assistant Examiner*—Thomas L. McShane
*Attorney, Agent, or Firm*—Potthast & Associates; James W. Potthast

[57] ABSTRACT

An aerosol valve assembly(12) has a mounting cup(18) with an arcuate bottom portion(43) that distorts during pressurization to absorb some of the pressure shock to enable pressurization at higher levels and a valve stem(22) with grooves(25) that define passageways through a bore(21) within which the valve stem(22) is slideably mounted to eliminate leakage through the bore and to reduce back pressure to enable good flow rates at reduced pressures.

47 Claims, 4 Drawing Sheets

AEROSOL VALVE ASSEMBLY AND METHOD OF MAKING AN AEROSOL CONTAINER

BACKGROUND AND INVENTION

1. Field of the Invention

This invention relates to an aerosol valve assembly and method of making an aerosol container and more particularly to an aerosol valve assembly of the type that is used to dispense viscous and semi-liquid material, such as whipped cream, hair styling mouse, shaving cream, etc., from within individually sized, hand carried, pressurized dispenser containers.

2. Discussion of the Prior Art

Known aerosol valve assemblies that are used to dispense semi-liquid and viscous materials, such as whipped cream, hair styling mousse, shaving cream and the like from individually sized pressurized containers of a size on the order of six to sixteen ounces employ a hollow, elongate, valve stem through which the material must pass when the valve is open. The material passageway through the hollow valve stem is relatively restricted, having a diameter of approximately only 1.0 millimeter.

The upstanding hollow valve stem is movably mounted to a mounting cup that, in turn, is fixedly seated in a central mounting hole of the top of a pressurized container of material to be dispensed. The mounting cup has an open circular top joined to a substantially flat circular bottom by a generally cylindrical wall. The flat bottom supports an upstanding tubular neck with a central, circular, mounting hole at its end. Fixedly contained within the neck is a resilient grommet with a central hollow, valve stem-mounting bore that opens at a valve seat within the container. A valve closure body at the end of the hollow valve stem presses against the valve seat to close the valve.

When the outside, distal end of the hollow valve stem is forced inwardly toward the container sufficiently to move the valve closure body away from sealing contact with the valve seat, the valve is actuated to an open position. In the open position the material, under pressure by virtue of the gas propellant, flows past the valve head and into the hollow valve stem at inlet openings to the material passageway that is defined by the hollow valve stem. The material flows through the inlet openings adjacent the valve closure member and through the hollow valve stem and out the open outlet end of the hollow valve stem.

Thus, the hollow valve stem is the actual conduit for the material being dispensed. An example of a valve of this general type but adapted for tilt operation of the hollow valve stem without use of a dispensing actuator is shown in U.S. Pat. No. 4,805,813 issued of Feb. 21, 1989, to Metcoff and the present inventor for "Aerosol Tilt Valve Mounting Cup And Assembly" to which reference should be made for further details of the basic construction and operation of the know aerosol valve assembly.

In this known valve assembly, it is of utmost importance, and special care is taken, that none of the material be allowed to enter into the valve stem mounting bore of the resilient grommet. Any material that passes through the bore simply messes the inside of the cup and is not received at the inlet end of dispensing actuator from the valve outlet opening at the end of the hollow valve stem. Accordingly, the relative dimensions are selected to insure a tight seal against such entry by means of continuous tight contact between the cylindrical outside surface and the cylindrical inside surface of the stem mounting bore throughout the length of the bore.

In the case of non-tilt valves that employ a dispensing actuator, the hollow valve stem extends upwardly above the open top of the mounting cup. Consequently, the relatively inflexible and fragile plastic hollow valve stem is only protected against breakage when the dispensing actuator is attached in protective covering and valve stem stabilizing relationship with respect to the valve stem. For this reason, the known valve assemblies are subject to breakage of the upwardly extending hollow valve stems during shipping, if shipped apart from the protective, dispensing actuator. Accordingly, separate shipping of valve assemblies is not performed in the ordinary course, and, instead, the valve assemblies are not shipped until attached to the pressurized containers and protected by attached dispensing actuators.

The known dispensing valve actuator has an elongate, hollow dispenser body pivotally mounted to a mounting collar that is snap fit over the edge of a rolled shoulder of the valve mounting cup. The elongate dispenser body has a relatively enlarged diameter that extends from a relatively enlarged inlet adjacent the mounting collar to a relatively distal, relatively enlarged distal outlet opening. The relatively enlarged inlet opening is connected in fluid communication through a relatively small diameter conduit transversely joined with a relatively small diameter hollow actuator.

The relatively small diameter hollow actuator slideably fits over the relatively narrow diameter, outlet end of the hollow valve stem to receive the material within its hollow body and convey it to a distal dispensing outlet opening.

When the hollow valve actuator is pressed down toward the container, the downward force is conveyed to the hollow valve stem to open the valve. When the valve is opened, the material within the aerosol container passes through the relatively small diameter hollow valve stem, the relatively small diameter hollow valve actuator member and the relatively small diameter conduit before connecting with the inlet end of the relatively large diameter dispenser body. The conduit interconnects the elongate, hollow dispenser body and the hollow valve actuator in a direction that is transverse to both of their elongate axes.

The inner diameter of the hollow valve stem is the smallest, being approximately 1-millimeter. The inner diameter of the hollow valve actuator and the conduit from the hollow valve actuator to the dispenser body is approximately only 4-millimeters. However, the diameter of the hollow dispenser body is approximately 10-millimeters—ten times that of the hollow valve stem.

The present inventor has determined that as a consequence of the "bottle neck" inherent in the above described designs of the known aerosol valve assembly and the associated dispensing aerosol valve actuator, for a given size container, the minimum amount of pressure needed to achieve an adequate flow rate must be much greater than would be needed if the cross-sectional area of the smallest diameter passageways were enlarged. Such enlargement facilitates the flow of material from the interior of the container to the relatively large cross section, elongate, hollow, dispenser body and reduces back pressure and the minimum pressure level needed to achieve adequate flow rate of material when the valve assembly is in an open state. In the case of existing valve assemblies used in conjunction with whipped cream containers, when the pressure within the container drops to approximately 90-psi, the flow rate of material is substantially slowed relative to the initial flow rate. After the pressure has been reduced to approximately 40-psi, then sealing between the valve stem mounting grommet and the flat bottom of the mounting cup is sufficiently reduced that leakage of the whipped cream often ensues.

On the other hand, the initial pressure must be sufficient to dispense all of the material within the container. This must be done even after most of the material has been dispensed and the volume available to the propellant gas has increased to thereby decrease the remaining pressure. The smaller the "bottle neck" caused by the relatively small diameter elements, the greater the pressure required to force the material out of the container through the valve and then out through the valve dispenser.

The inventor has also observed that because of the flat bottom design of the known mounting cups, this low pressure problem cannot be solved simply by increasing the level of the initial pressure, although unsuccessful attempts have been made.

There is a limit to which the known aerosol containers are capable of being initially pressurized without causing commercially unacceptable problems. The inventor has noted that if this limit is exceeded, then there is a risk of outward bowing distortion of the flat bottom of the mounting cup and resultant creation of gaps in the normal continuous contact seal between the valve mounting cup and the valve stem mounting grommet.

As noted above, the valve mounting cup has a generally cylindrical shape with a flat bottom, when made, and care is taken to ensure that when installed the pressure of the container is not sufficiently great to bend upwardly or otherwise distort the flat bottom. The substantially flat bottom extends in a plane from the central opening all the way to the perimeter side wall. Because of this configuration, the inventor has determined the flat bottom has a tendency to bow upwardly in response to the internal pressure acting in a single direction across the entire bottom. Such bowing of the flat bottom creates leaks between the bearing shoulder above the valve seat and the cup bottom resulting in material passing between the sides of the tubular neck within which the grommet body is mounted and bypassing the dispenser body.

Also, if the standard one mil thickness of the mounting cup is increased to prevent bowing of the flat bottom, despite the increased cost and weight caused by such thickening, excessive initial pressure applied to the container during pressure loading of the container is capable of loosening the seal between the mounting cup and the container.

The amount of pressure that the valve assembly can withstand places an upper limit on the quantity of dispensable material that can be contained within a pressurized container of given size. Thus, an approach of carefully pressurizing the containers to avoid any distortion of the flat bottom of the mounting cup is a further limitation on the maximum amount of material that a given sized aerosol container is capable of dispensing.

More specifically, the known aerosol valve assembly of the prior art functions satisfactorily only in relatively low pressure applications in which the initial internal pressure of the container is in the range from 130-psi to 140-psi. When the pressure drops approximately 50 to 60-psi, due to use, to a range of 70 to 80-psi, then the rate of dispensing is substantially slowed relative to the initial flow rate when at maximum pressure. This is due in part to the "bottle neck problem caused in part by the small valve opening, noted above. When the pressure drops further to approximately 40-psi, then the valve begins to lose the seal between the valve head and the valve stem and the valve begins to leak. Because of the disadvantageous features that have been discerned by the present inventor, the known aerosol valve assembly is less than entirely satisfactory in its performance when the pressure is in a range from 90-psi to 40-psi and is completely unsatisfactory when the pressure drops below 40-psi.

The amount of material that can be dispensed from the pressurized container is limited by the amount of propellant available. The amount of dispensing propellant that can be placed in the container is directly proportional to the internal pressure. Consequently, the inability of the known aerosol valve assembly to function well under relatively low pressure conditions creates a practical limit on the amount of material that can be usefully stored within a container of any given size. It is wasteful to place more material in the container than the maximum that can be dispensed from the container.

The inability of know valve assemblies to withstand higher pressures prevents increasing the initial pressure into a range to enable sufficient pressure for good flow rates for all the material being dispensed while eliminating leakage due to pressure decreases beneath the minimum needed for proper sealing of the valve stem grommet against the bottom of the mounting cup and closure of the valve head against the valve seat.

SUMMARY OF THE INVENTION

It is therefore the principal object of the invention to provide a relatively high pressure aerosol valve assembly and assembly parts with features that overcome the above disadvantages of the known aerosol valve assembly and parts discussed above to facilitate use with containers under relatively high internal pressure and which reduce the minimum amount of pressure needed to dispense a given amount of material and to provide a method of making an aerosol container incorporating the relatively high pressure aerosol valve assembly.

This objective is achieved in part through provision of an aerosol valve assembly with a valve stem mounting member having a valve seat, and a material passageway with an interior side wall extending between an inlet opening adjacent the valve seat and an outlet opening, and a valve stem with an elongate stem body having an exterior surface with at least a portion spaced at least partly from the interior side wall to enable the material received within the inlet opening to move through the material passageway and past the at least partly spaced potion of the exterior surface, and in which the valve stem has a valve head attached to an end of the elongate stem body, said elongate stem body being mounted within the material passageway for movement between an open position in which a valve head attached to one end of the elongate stem body is spaced from the valve seat to enable the movement of material into the inlet opening of the passageway, and a closed position in which the valve head is pressed against the valve seat to disable the passage of material into the inlet opening.

Preferably, the valve stem is mounted for sliding movement between the open position and the closed position and the exterior surface of the valve stem body has another portion that is in sliding engagement with the interior side wall of the material passageway.

Also, the aerosol valve assembly preferably includes a valve mounting cup with a cup side wall extending between an open top and a bottom with a central valve mounting hole for attaching receipt of the valve stem mounting member, and the valve stem mounting member, when received in attaching relationship with the central valve mounting hole, has an upper portion with the outlet opening that is located entirely within the mounting cup, said upper portion extending upwardly from the bottom of the mounting cup to no further than an upper edge of the open top, and a lower portion having the valve seat and inlet opening and being located outside of the cup. Preferably, the valve stem has an actuator engagement member at another end of the elongate stem body opposite the one end with the valve head, said actuator engagement member being entirely contained within the passageway adjacent the outlet opening in the upper portion of the valve stem mounting member.

The actuator engagement member is relatively enlarged compared to the elongate stem body, having a cross sectional dimension that is greater than that of the elongate stem body, and the passageway adjacent the outlet opening is relatively enlarged compared to the passageway adjacent the inlet opening and protectively surrounds the elongate stem body to accommodate the relatively enlarged actuator engagement member. The passageway adjacent to the outlet opening having a cross sectional dimension greater than that of the actuator engagement member to enable the movement of material past the actuator engagement head and through the outlet opening. In this way, the valve passageway is not limited to the diameter of the valve stem as in the hollow valve stem of known valve assemblies.

In keeping with another aspect of the invention, the valve mounting cup has a side wall extending between a bottom with a mounting hole and a top with an upper edge for mounting the valve stem mounting member. The valve stem has an end opposite the valve head for engagement with a valve stem actuator located adjacent the outlet opening and entirely within the valve mounting cup and extending no further than the upper edge of the open top. The opposite end of the valve stem is protectively contained within the passageway adjacent the outlet opening, and the upper portion of the valve mounting member includes an annular mounting collar surrounding and extending radially outwardly from the upper portion of the valve stem mounting member for sealing engagement with a dispensing inlet opening of a dispensing actuator assembly for sealed fluid communication between the valve outlet opening and the dispensing actuator assembly.

In accordance with another aspect of the invention the aerosol valve assembly is combined with a mating dispensing actuator having a dispensing inlet opening in sealed engagement with the valve outlet opening and a dispensing outlet opening in fluid communication with the dispensing inlet opening through a hollow dispensing body. The mating dispensing actuator includes a valve actuator member located within the hollow dispensing body and the valve actuator member is at least partly spaced from an interior side wall of the hollow dispensing body to provide a passageway for material to flow past the actuator member between the dispensing inlet opening and the dispensing outlet opening. The valve stem mounting member has an annular collar surrounding the dispensing outlet opening at an end of the valve stem mounting member located oppositely of the valve seat for sealing engagement within an inlet end of the hollow dispenser body.

The principal object of the invention is also achieved in part by provision of an aerosol valve assembly with a valve mounting cup with an open top and a bottom with a valve mounting hole, a valve stem mounting member with a material passageway extending through an intermediate section mounted within the valve mounting hole and extending between a valve seat with a valve inlet opening to the material passageway at an underside of the cup, and an annular collar extending outwardly beyond the mounting hole and above the bottom of the cup and surrounding a valve outlet opening from the material passageway for releasable sealing receipt within a mating dispensing inlet opening of a hollow body of a dispensing actuator, a valve stem with a body and a valve head, and means for mounting the valve stem for movement relative to the valve stem mounting member between a closed position in which a dispensing inlet opening of the passageway is blocked by the valve head, and an open position in which the valve head is spaced from the valve seat to enable entry of material into the valve inlet opening to the passageway.

Preferably, the aerosol valve assembly has an annular collar that surrounds the upstanding neck and extends outwardly from the intermediate section to define a shoulder that overlies the neck and blocks removal of the intermediate section from the neck. The material passageway adjacent the valve outlet opening has an enlarged section that is enlarged relative to the valve stem to facilitate the movement of material past a relatively enlarged actuator engaging end of the valve stem located within the relatively enlarged section.

The open top, the bottom and the valve mounting hole are all substantially circular, and the circular bottom is joined to the circular open top by a cylindrical side wall section and an arcuate, preferably torroidal, wall section joining the flat circular bottom to the cylindrical wall. The arcuate wall section extends from adjacent the central circular valve assembly mounting hole to a juncture with the cylindrical wall at a location substantially above the substantially flat bottom portion. The valve mounting cup includes an upstanding valve mounting neck surrounding the central valve mounting hole that extends upwardly from the bottom of the cup to a location substantially aligned with the juncture between the cylindrical wall section and the arcuate wall section.

With this configuration the mounting cup can withstand greater amounts of pressure without being blow off the open top of the container by distorting to absorb the initial pressure shock. The relatively arcuate bottom is pushed upwardly and generally flattened to an optimum position with the upstanding neck in a relatively elevated position beneath the top of the cup but engageable by the valve actuator member carried by the dispensing actuator.

The objective is also achieved by provision of an aerosol valve assembly with a valve body mounted to a valve mounting cup and having a material passageway that extends through the valve mounting cup to a valve outlet opening, a valve stem assembly with a stem body mounted for sliding movement within the material passageway between an open position and a closed position, and means for connecting the valve outlet opening to a dispensing hollow body.

Additionally, the objective of the invention is achieved in part by provision of an aerosol valve assembly, having a valve mounting cup with an open circular top, a substantially flat circular bottom portion with a central circular valve assembly mounting hole, a cylindrical side wall, and an arcuate wall section joining the flat circular bottom to the cylindrical wall and extending from adjacent the central circular valve assembly mounting hole to a juncture with the cylindrical wall at a location substantially above the flat bottom portion, and a valve assembly mounted within the central circular valve mounting hole. Preferably, the arcuate portion is torroidal in shape and extends to substantially midway between the flat bottom portion and the open top.

With this configuration, higher pressures are achievable. In accordance with another aspect of the invention, an aerosol container containing dispensable material is manufactured by making a valve mounting cup with a nonpressurized configuration that is distortable to a preselected optimum configuration different from the nonpressurized configuration, attaching an aerosol valve assembly to a valve mounting cup when in the nonpressurized configuration, fastening the mounting cup to a pressurizable container, inserting dispensable material containing material to be dispensed, pressurizing the container with a propellant gas until the mounting cup distorts from the nondistorted configuration to the preselected optimum configuration.

Preferably, the mounting cup has a bottom with a central flat portion surrounded by an arcuate portion when in the nondistorted configuration, and at least part of the arcuate portion adjacent the flat portion distorts to a relatively flattened optimum configuration substantially coplaner with the central flat portion during the step of pressurizing. Also, the cup has an open top and a bottom with a central grommet mounting hole surrounded by an elongate, upstanding neck extending upwardly toward the open top and spaced beneath the open top by a preselected amount when in the nondistorted configuration, and the upstanding neck is moved upwardly to a distorted optimum position spaced beneath the open top by another amount less than the preselected amount during the step of pressurizing. Preferably, the mounting cup has an open top and a bottom with a central flat portion spaced from the open top by a preselected amount when in a nondistorted configuration, and the central flat portion of the bottom is moved upwardly toward the open top to an optimum position at which it is spaced from the open top by another amount less than the preselected amount during the step of pressurizing.

In accordance with the invention, the step of pressurizing includes the step of pressurizing the container to a pressure substantially greater than 140 pounds per square inch and to a pressure between 150-psi and 200-psi.

BRIEF DESCRIPTION OF THE DRAWINGS

The foregoing objects and advantageous features of the invention will be described in detail and further advantageous features will be made apparent from the following detailed description of the preferred embodiment that is given with reference to the several views of the drawings in which.

DETAILED DESCRIPTION

Figure 1A:
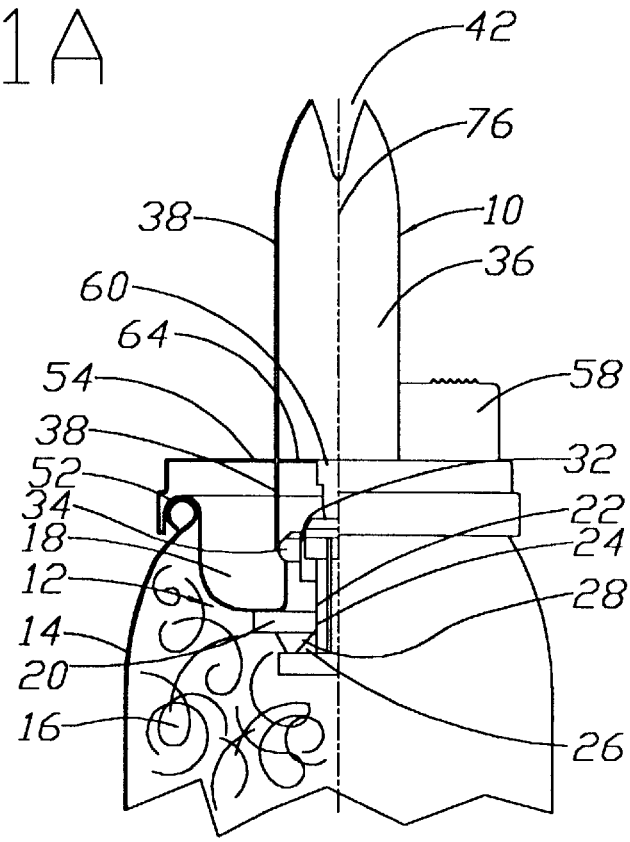
FIG. 1A is a side elevational view, partly in section, of the of the preferred embodiment of the aerosol valve assembly of the present invention in an unactuated, or closed, state, attached to an aerosol container and with an associated dispensing actuator attached.
Figure 1B:
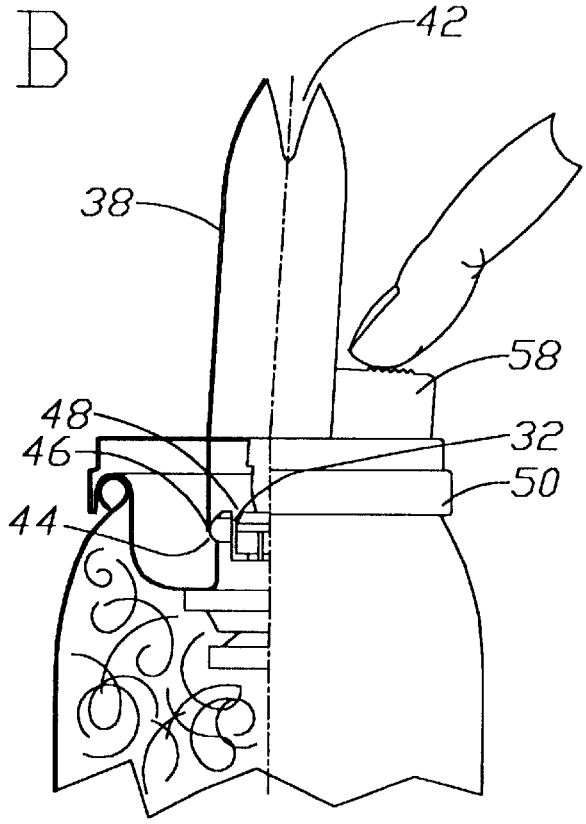
FIG. 1B is an elevational side view of the preferred embodiment of the aerosol valve assembly and associated dispensing actuator and container of FIG. 1A but with the valve assembly in an actuated, or open, state.
Figure 2A:
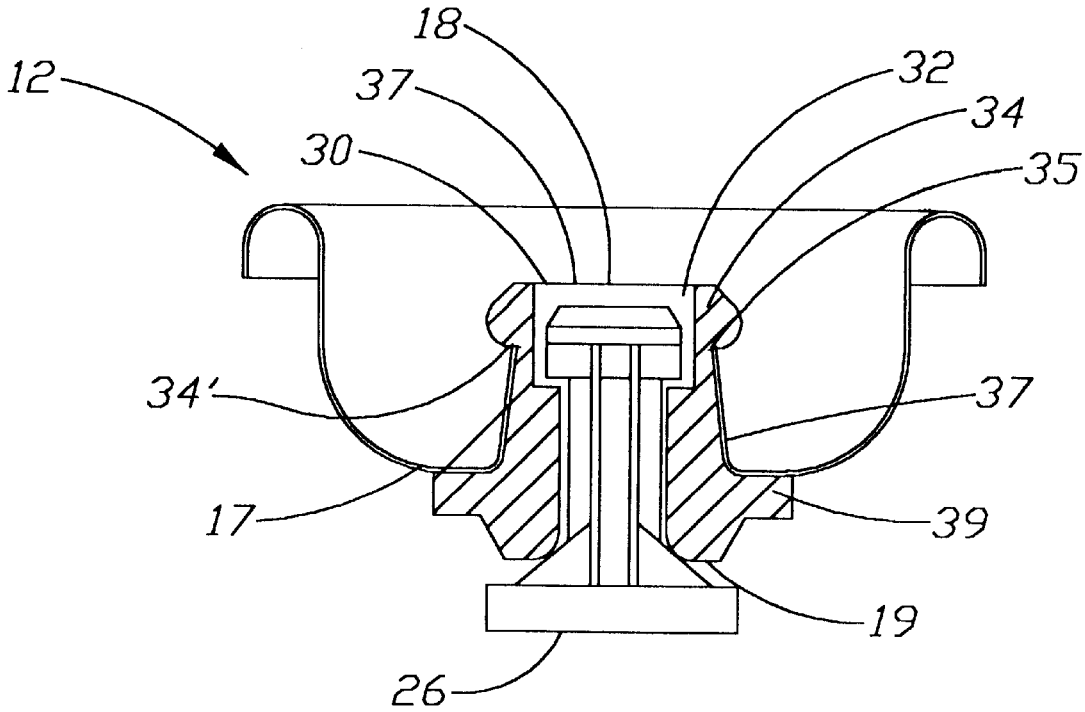
FIG. 2A is a sectional side elevational view of the aerosol valve assembly of FIGS.1A and 1B shown apart from the associated dispensing actuator and the container and with the mounting cup in the preselected, non-distorted shape prior to pressurization.
Figure 2B:
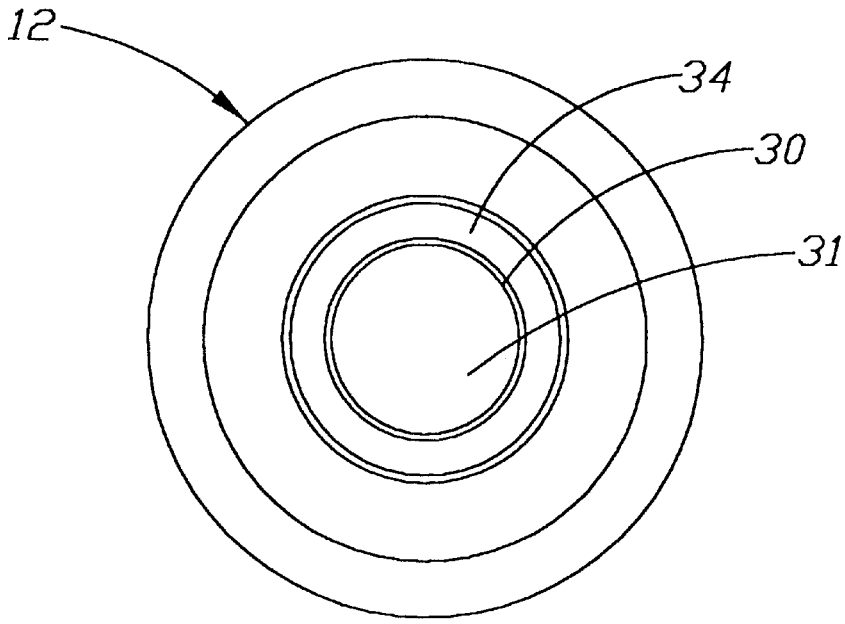
FIG. 2B is a top view of the valve assembly of FIG. 2A.

Referring to FIGS. 1A and 1B and 2A, the preferred embodiment of the aerosol valve assembly 12 of the present invention is seen with an attached aerosol dispensing actuator 10. The aerosol valve assembly 12, in turn, is attached to the top of an aerosol container 14 of a viscous material 16, such as whipped cream and the like, to be selectively dispensed.

Figure 4A:
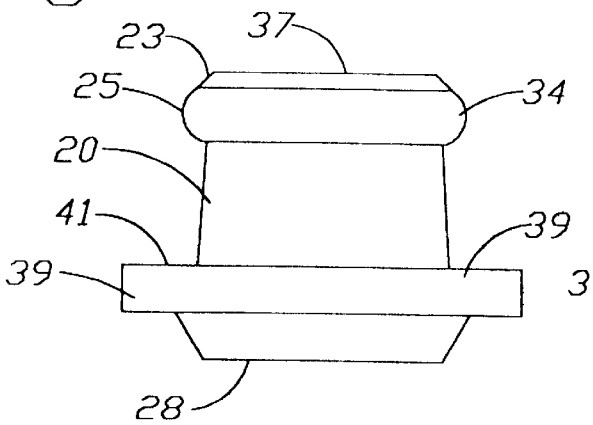
FIG. 4A is a side view of the valve stem mounting grommet of the aerosol valve assembly of FIGS. 1A–2C.
Figure 4C:
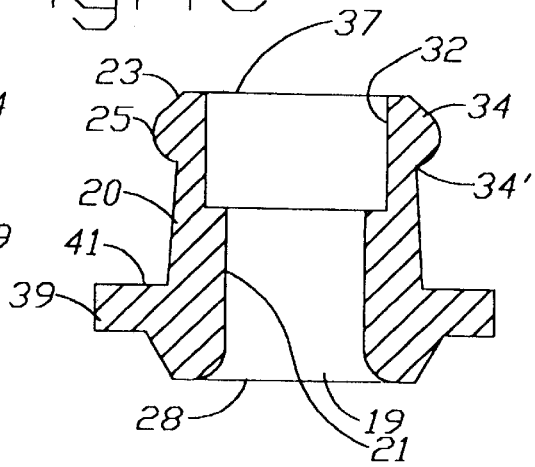
FIG. 4C is a sectional side view of the grommet taken through section line IVC—IVC of FIG. 4B.
Figure 4B:
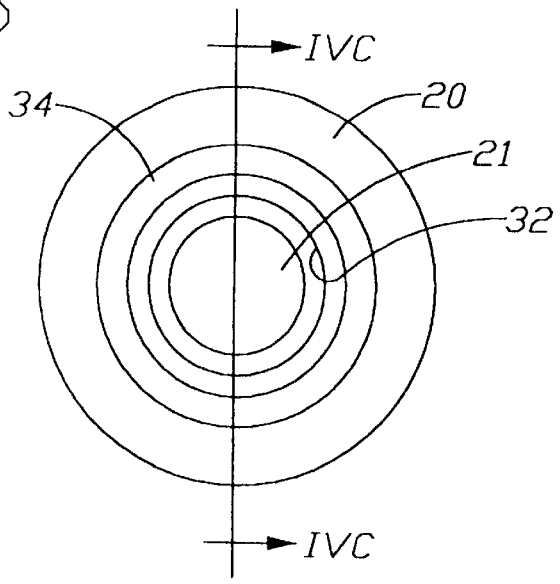
FIG. 4B is an end view of the grommet as viewed from the right hand side of FIG. 4A.
Figure 5:
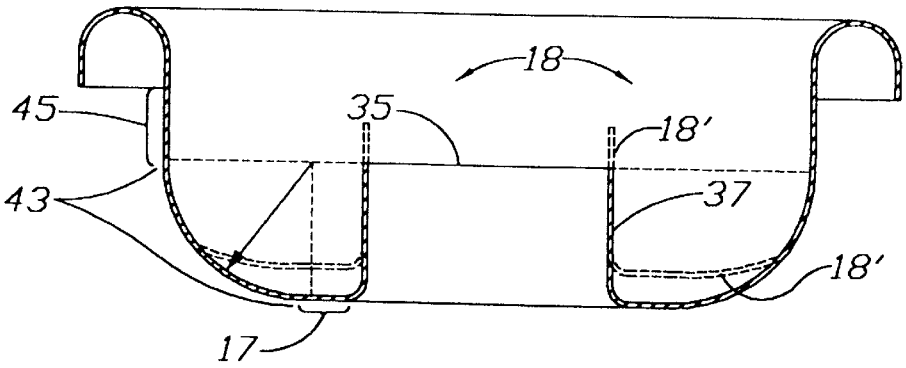
FIG. 5 is a sectional side view of the valve mounting cup of the aerosol valve assembly of FIG. 2A in its preselected nondistorted configuration prior to pressurization and also showing in broken line the distorted configuration after pressurization.

The aerosol valve assembly 12 includes a valve mounting cup 18, also shown in enlarged cross section in FIG. 5, that fits into and seals closed an open top of the container 14. The bottom of the cup has a central opening 19, FIG. 5, which is sealed closed by a rubber-like, resilient, valve stem mounting grommet 20, also shown in enlarged views in FIGS. 4A, 4B and 4C. The mounting grommet has a central opening, or bore, 21, FIGS. 4C and 4B, within which is mounted a valve stem 22, also shown in FIGS. 3A, 3B and 3C. The valve stem 22 has an elongate shank 24 within which are located a plurality of grooves 25, FIGS. 3A–3C, that define passageways along the shank 24 between the shank 24 and the interior surface of the bore 21 within the grommet 20.

An interior end of the shank 24 carries a valve closure member 26 that is normally pressed against a mating valve seat 28 of the grommet 20 by the internal pressure within the container 20 except when the valve is manually actuated to an open position, as shown in FIG. 1B.

When the valve assembly 12 is not actuated to an open position, the valve closure member is sealed against the valve seat 28 to close off fluid communication between the interior of the container 14 and the interior of the central shank mounting bore 21 of the grommet 20. This is the closed valve position illustrated in FIG. 1A.

Figure 3A:
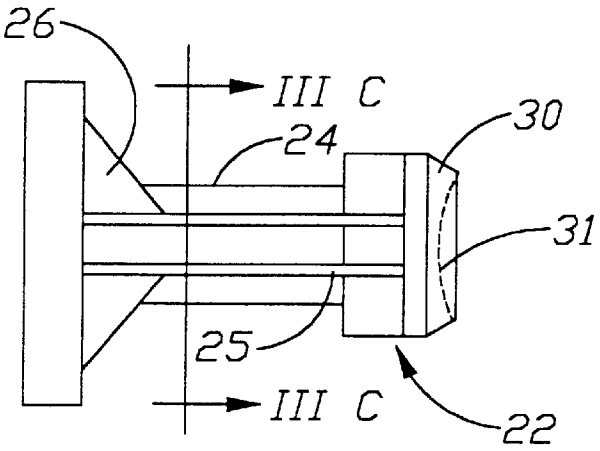
FIG. 3A is a side elevational view of the valve stem of the aerosol valve assembly of FIGS. 1A–2B.

The end of the shank 24 opposite of the closure member 26 has an actuator engagement head 30 with a concave surface 31, FIG. 3A, facing upwardly toward the actuator assembly 10. The actuator engagement head 30 fits loosely within a well 32. Surrounding the well 32 is an annular collar 34. The collar has a shoulder 34' that extends radially outwardly over an end 35 of an upstanding neck 37, FIGS. 2A and 5, surrounding the central, grommet mounting opening 19 and extending upwardly from the bottom 17 of the cup 18 to hold the grommet against relative downward movement with respect to the mounting cup 18.

Another collar 39 extends radially outwardly from the central portion of the grommet 20 held within the upstanding neck 37 and underlies an annular, substantially flat bottom portion 17 of the mounting cup surrounding the valve inlet opening 19 to block upward movement of the grommet 20 relative to the mounting cup 18.

When the valve actuator engagement head 30 is pressed downwardly by a sufficient amount to unseal the mating sealed relationship between the valve closure member 26 and the valve seat 28, as illustrated in FIG. 1B, the valve is open. When the valve is open, the material 16 within the container 14 is forced into the valve inlet opening 19 and through the central bore 21 along the elongate slots, or grooves, 25 in the shank 24, then into the well 32 and out of the valve outlet opening 37 surrounded by the annular collar 34.

Referring still to FIGS. 1A and 1B, the aerosol valve dispensing actuator assembly 10 has a dispenser 36 with an elongate, hollow body 38. The hollow body 38 has a generally cylindrical side wall that extends between an inwardly tapered, distal end 40 with a slotted outlet dispenser opening 42 and a dispenser inlet opening 44, FIG. 1B. A bottom portion 46 of the side wall 38 adjacent the inlet opening 44 has an interior surface in sliding, sealed engagement with the annular collar 34 and surrounds the valve outlet opening 48 of the valve assembly 12 at the top of the well 32.

An annular mounting collar 50 is resiliently snap fit over an exposed peripheral edge 52 of the mounting cup 18 to fasten the dispensing actuator assembly 10 to the valve assembly 12. When the annular mounting collar, or mounting collar, 50 is attached, an interior surface of the portion 46 of the wall 38 is relatively positioned for sealing movable receipt of the collar 34 of the valve stem mounting grommet 20. The elongate hollow body 38, in turn, is mounted to a disk 54 at the top of the mounting collar 50.

The disk 54, in turn, is mounted for pivotal movement relative to the mounting collar 54 and to the valve assembly 12 to which it is attached by means of a resilient, flexible plastic hinge (not shown). A raised, finger engagement member 58 with a serrated top is also mounted to the top of the disk 54 between the hollow body 38 and the peripheral edge of the disk 54 radially opposite of the hinge.

A valve actuator member 60 is mounted centrally within the dispenser body 36 by means of a mounting assembly 62 that includes a pair of mounting members 64 (only one being shown). The mounting members 64 interconnect opposite sides of a relatively enlarged diameter top of the actuator member 60 to diametrically opposite interior sidewall sections of the interior of the elongate, side wall 38.

The actuator member 60 has a diameter substantially less than that of the hollow dispenser body 36. The mounting members including mounting member 64 have a width that is less than the diameter of the actuator member 60 which, in turn, is substantially less than the diameter of the dispenser inlet opening. Consequently, the actuator member 60 is spaced from sidewall portions and thereby creates a pair of relatively large passageways having a cross sectional area on the same order as that of the dispensing actuator inlet opening, the elongate hollow body 36 and the outlet opening 42. These passageways extend between the side wall and the valve actuator member 60 for the flow of the material 16 past the actuator member 60 between the dispenser inlet opening 44 and the dispenser outlet opening 42. The side wall portion thus substantially surrounds the valve actuator 60.

The elongate sidewall 38 extends in substantially one direction symmetrically along a central axis 76 between the dispenser inlet 44 and the dispenser outlet 42. The valve actuator member 60 has a tapered section that extends downwardly from a relatively enlarged section adjacent the connection with the mounting collar 52 to a generally semi-spherical engagement end.

The valve stem engagement head 30 has a semi-spherically concavity 31 in its top that faces upwardly toward the actuation member 60, and the rounded engagement end is adapted to nestle into the concavity 31.

When the finger engagement member 58 is pressed downwardly, as shown in FIG. 1B, to actuate the valve, then the entire disc 54 pivots downwardly around the axis of the hinge 56. The disc 54 carries with it the elongate hollow dispense body 36 and the valve actuator member 60 for movement relative to the valve stem 12. The valve actuator member 60 is moved downwardly into engagement with the valve stem head 30 while the interior surface of the dispenser wall 38 adjacent the dispenser inlet opening 44 slides downwardly on the outwardly facing surface of the collar 34 of the grommet 20 while maintaining a sealed relationship. The grommet 20 including the collar 34 are made of firm but resilient, rubber-like material and is also capable of distorting to assist in maintain the seal during relative movement of the interior surface of the grommet engaging wall section 46 against the collar 34.

When the valve is opened the material 16 passes out of the well 32 and is received within the dispenser inlet opening 44. As explained, the material 16 is then forced upwardly through the passageways and past the sides of the actuator member 60 and then along the length of the dispenser body 36 and out of the outlet opening 42. In the case of whipped cream, the material then passes, hopefully, upon the top surface of a piece of pumpkin pie. Because of the relatively enlarged passageways that extend past the actuator member 60, as compared to the passageway through the center of the valve stem itself, less propellant and more whipped cream is available for storage in the container 14.

Preferably the material flows substantially entirely around the valve actuator member 60, although in the case of an of center dispenser of a styling mousse dispense described below with reference to FIG. 4, the material 16 flows past more on one side than another. The step of mounting preferably includes surrounding the upstanding neck with the resilient collar 34 and receiving the resilient collar 34 within the grommet engaging wall portion 46 for sealed mating receipt within the inlet portion 46.

For further details concerning the construction and operation of the aerosol valve dispensing actuator assembly and method of use, reference should be made to the present inventor's copending patent application of the present inventor filed contemporaneously herewith and entitled, "Aerosol Valve Dispensing Actuator Assembly and Method of Dispensing"

Figure 3C:
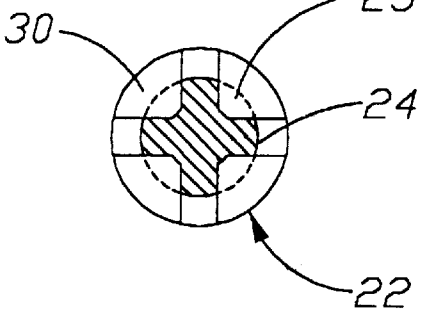
FIG. 3C is a sectional view of the valve stem taken through section line IIIC—IIIC of FIG. 3A.
Figure 2C:
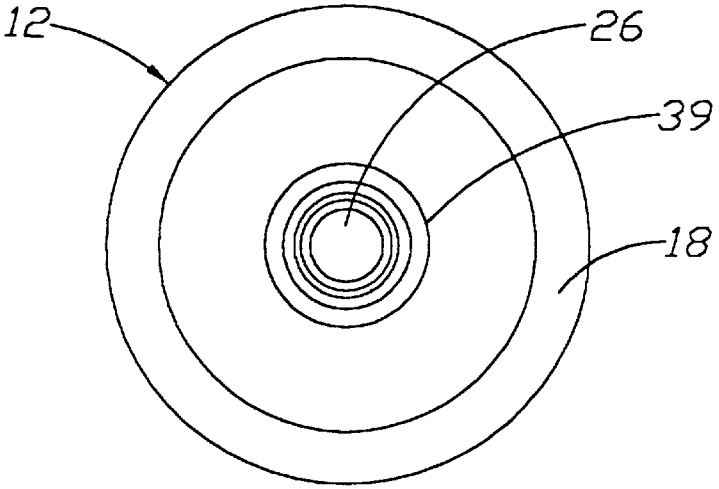
FIG. 2C is a bottom view of the valve assembly of FIG. 2A.
Figure 3B:
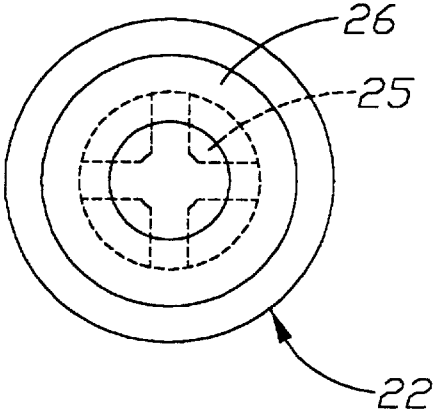
FIG. 3B is an end view of the valve stem of FIG. 3A as viewed from the actuator engaging end of the right hand side of FIG. 3A.

Referring to FIGS. 3A–3C, the valve stem 24 has an elongate shank 24 within which are located a plurality of grooves 25, preferably four, that define passageways along the shank 24 between the shank 24 and the interior surface of the bore within the grommet 20. The actuator engagement head 30 has a concavity 31 to facilitate engagement with the actuator member 60. The valve stem is preferably made of ABS plastic and is relatively rigid compared to the grommet 20 that is preferably made of Santoprene thermoplastic made by Monsanto Company, or other like resilient material.

An interior end of the shank 24 carries the valve closure member 26 that is normally pressed against the mating valve seat 28 of the grommet 20, FIGS. 4A–4C, by the internal pressure within the container 20 except when the valve is manually actuated to an open position. When the valve is not actuated to an open position, the valve closure member is sealed against the valve seat 28 to close off fluid communication between the interior of the container 14 and the interior of the shank mounting bore 21. This is the closed valve position illustrated in FIG. 1A.

As noted the end of the shank 24 opposite of the closure member 26 has an actuator engagement head 30 with a concave surface 31 facing upwardly toward the actuator assembly 10. The actuator engagement head 30 fits loosely within a well 32. Surrounding the well 32 is an annular collar 34 that extends radially outwardly over of an upstanding neck 37 surrounding the central grommet mounting opening in the bottom of the cup 18 in the top of the grommet 20. When the valve actuator engagement head 30 is pressed downwardly by a sufficient amount to unseal the mating sealed relationship between the valve closure member 26 and the valve seat 28, as illustrated in FIG. 1B, the valve is open. When the valve is opened, the material 16 within the container 14 is forced through the valve inlet opening of the central bore 21 along the elongate slots in the shank 24, then into the well 32 and out of the valve outlet opening surrounded by the annular collar 34.

Referring also to FIGS. 1A, 1B and 1C, an annular mounting collar 50 is resiliently snap fit over an exposed peripheral edge 52 of the mounting cup 18 to fasten the dispensing actuator assembly 10 to the valve assembly 12. When the annular mounting collar, or mounting collar 50 is attached, an interior surface of the portion 46 of the wall 38 is relatively positioned for sealing movable receipt of the collar 34 of the valve stem mounting grommet 20 when the cup is in its distorted optimum configuration as shown in FIGS. 1A and 1B and shown by broken line 18' in FIG. 5.

Referring to FIGS. 4A, 4B and 4C, the grommet 20 is preferably made of Santoprene thermoplatistic made by Monsanto Company or other like resilient material. The mounting collar preferably has a convex, radially outwardly extending surface that engages the inner surface of the cylindrical inlet wall of the dispensing actuator assembly 10 along a tangential line of engagement to facilitate relative pivotal movement while maintaining a good sealing engagement. Preferably the collar has a tapered section 23 that merges with a generally torroidal, O-ring section 25. The substantially flat circular bottom portion 17 of the mounting cup 18 prior to distortion, as shown in FIGS. 2A and 5, located closely adjacent to the central circular valve mounting hole extends radially outwardly no further than necessary to be coextensive with and thereby provide a flat sealing surface for mating bearing engagement with the flat outer surface 41 of the collar prior to pressurization and resultant distortion of the mounting cup 20. The arcuate wall section 43 joins the cylindrical side wall section 45 at a juncture substantially removed from the flat bottom portion 17 prior to distortion, as best seen in FIG. 5. As seen if FIG. 5 and also as shown if FIGS. 1A and 1B, during pressurization, the flat bottom portion 17 moves upwardly toward the open top of the cup 18 and carries with it the neck 37 that also moves upwardly with the flat bottom portion 17. This upward movement is permitted by virtue of part of the arcuate wall portion 43 flattening out and moving upwardly to a position generally coplaner with the flat bottom portion 17. This distortion moves the top of the neck 37 and the valve stem 22 carried thereby into proper position for engagement with the valve actuator member 60, and absorbs the pressure shock during initial pressurization of the container 14 to enable higher initial pressures than permitted by the known aerosol valve assemblies. Specifically, pressures as high as 200-psi are enabled by this new design, as opposed to the 140-psi limit imposed on the known valve assemblies with mounting cups of the same standard gage thickness.

Thus, in accordance with the invention, an aerosol container containing dispensable material, is manufactured by (1) making a valve mounting cup with a nonpressurized configuration that is distortable to a preselected optimum configuration different from the nonpressurized configuration, (2) attaching an aerosol valve assembly to a valve mounting cup when in the nonpressurized configuration, (3) fastening the mounting cup to a pressurizable container, (4) inserting dispensable material containing material to be dispensed, (5) pressurizing the container with a propellant gas until the mounting cup distorts from the nondistorted configuration to the preselected optimum configuration. Preferably, at least part of the arcuate portion adjacent the flat portion distorts to a relatively flattened optimum configuration substantially coplaner with the central flat portion during the step of pressurizing. Likewise, preferably the neck 37 extends upwardly toward the open top and is spaced beneath the open top by a preselected amount, approxiamtely aligned with the juncture between the arcuate wall section 43 and the cylindrical wall section 45 when in the nondistorted configuration, and the upstanding neck 37 is moved upwardly to a distorted optimum position spaced beneath the open top by another amount less than the preselected amount during the step of pressurizing. Preferably, the central flat portion of the bottom is moved upwardly toward the open top to an optimum position at which it is spaced from the open top by another amount less than the preselected amount during the step of pressurizing. Pressurizing is performed by pressurizing the container to a pressure substantially greater than 140 pounds per square inch and preferably the container is pressurized to a pressure between 150-psi and 200-psi.

What is claimed is:

1. An aerosol valve assembly, comprising:

a valve stem mounting member having a valve seat, an inlet opening adjacent the valve seat, a distal outlet opening and a material passageway with an interior side wall extending between the inlet opening and the distal outlet opening; and a valve stem with an elongate stem body having an exterior surface within the material passageway and having at least a portion spaced substantially from the interior side wall to enable the material received within the inlet opening to move through the material passageway between the interior side wall and the substantially spaced portion of the exterior surface of the stem body, said valve stem having a valve head attached to an end of the elongated stem body, said elongate stem body being mounted for sliding movement within the material passageway between an open position in which the valve head is spaced from the valve seat to enable the movement of material into the inlet opening of the passageway, and a closed position in which the valve head is pressed against the valve seat to disable the passage of material into the inlet opening.

2. The aerosol valve assembly of claim 1 in which the valve stem is mounted for sliding movement between the open position and the closed position.

3. The aerosol valve assembly of claim 1 in which the exterior surface of the valve stem body has another portion that is in sliding engagement with the interior side wall of the material passageway.

4. The aerosol valve assembly of claim 1 including a valve mounting cup with a cup side wall extending between an open top and a bottom with a central valve mounting hole for attaching receipt of the valve stem mounting member, and in which the valve stem mounting member, when received in attaching relationship with the central valve mounting hole, has an upper portion with the outlet opening that is located entirely within the mounting cup, said upper portion extending upwardly from the bottom of the mounting cup no further than an upper edge of the open top, and a lower portion having the valve seat and an inlet opening that is located outside of the cup.

5. The aerosol valve assembly of claim 1 in which the valve stem has an actuator engagement member at another end of the elongate stem body opposite the one end with the valve head, said actuator engagement member being entirely contained within the passageway adjacent the outlet opening in the upper portion of the valve stem mounting member.

6. The aerosol valve assembly of claim 5 in which the actuator engagement member is relatively enlarged compared to the elongate stem body, having a cross sectional dimension that is greater than that of the elongate stem body, and the passageway adjacent the outlet opening is relatively enlarged compared to the passageway adjacent the inlet opening and protectively surrounds the elongate stem body to accommodate the relatively enlarged actuator engagement member, said passageway adjacent to the outlet opening having a cross sectional dimension greater than that of the actuator engagement member to enable the movement of material past the actuator engagement head and through the outlet opening.

7. The aerosol valve assembly of claim 1 including a valve mounting cup with a side wall extending between a bottom with a mounting hole and a top with an upper edge for mounting the valve stem mounting member, and in which, the valve stem has an end opposite the valve head for engagement with a valve stem actuator located adjacent the outlet opening and entirely within the valve mounting cup and extending no further than the upper edge of the open top.

8. The aerosol valve assembly of claim 7 in which the opposite end of the valve stem is protectively contained within the passageway adjacent the outlet opening, and the upper portion of the valve mounting member includes an annular mounting collar surrounding and extending radially outwardly from the upper portion of the valve stem mounting member for sealing engagement with a dispensing inlet opening of a dispensing actuator assembly for sealed fluid communication between the valve outlet opening and the dispensing actuator assembly.

9. The aerosol valve assembly of claim 8 in which the annular collar is integrally formed with the upper portion of the valve stem mounting member, and defines a shoulder that radially extends beyond the central valve mounting hole to block sliding movement of the upper portion of the valve stem mounting member downwardly toward the bottom of the valve mounting cup.

10. The aerosol valve assembly of claim 9 in which the valve stem mounting cup includes an upstanding hollow neck that extends upwardly from the bottom of the mounting cup for protectively surrounding and laterally stabilizing at least part of the upper portion of the valve stem mounting member outlet of the central valve mounting hole, and the shoulder defined by the annular mounting collar both overlies the upstanding hollow neck and surrounds the upstanding neck.

11. The aerosol valve assembly of claim 1 in combination with a mating dispensing actuator having a dispensing inlet opening in sealed engagement with the valve outlet opening, and a dispensing outlet opening in fluid communication with the dispensing inlet opening through a hollow dispensing body.

12. The aerosol valve assembly of claim 11 in which the mating dispensing actuator includes a valve actuator member located within the hollow dispensing body.

13. The aerosol valve assembly of claim 12 in which the valve actuator member is at least partly spaced from an interior side wall of the hollow dispensing body to provide a passageway for material to flow past the actuator member between the dispensing inlet opening and the dispensing outlet opening.

14. The aerosol valve assembly of claim 12 in which the actuator member has an inwardly tapered engagement end for engagement with an actuator engagement end of the valve stem located opposite the valve head and the actuator engagement end includes a recess for mating receipt of the inwardly tapered engagement end.

15. The aerosol valve assembly of claim 12 in which the valve stem has an actuator engagement end with a recess having inwardly sloping sides for slideably engaging the actuator member to guide the actuator member into full engagement within the recess.

16. The aerosol valve assembly of claim 12 in which the valve stem has an actuator engagement end with a recess having interior sides for blocking relative lateral movement of the mating actuator out of proper engagement alignment with the actuator engagement member after the mating actuator is received within the recess.

17. The aerosol valve assembly of claim 1 in which the valve stem mounting member has an annular collar surrounding the dispensing outlet opening at an end of the valve stem mounting member located oppositely of the valve seat for sealing engagement within an inlet end of a hollow dispenser body.

18. The aerosol valve assembly of claim 17 in which the annular collar has a has an outwardly extending torroidal surface defining an O-ring section for sealing engagement within the inlet end of the dispenser body.

19. The aerosol valve assembly of claim 18 in which the annular collar has a truncated conical surface joined to the torroidal surface to provide a tapered guide for sliding insertion of the annular collar into the inlet end of the hollow dispensing body.

20. The aerosol valve assembly of claim 17 including a valve mounting cup with a bottom having a valve mounting hole for snug mounting receipt of an intermediate section of the valve stem mounting member, and in which the annular collar defines a shoulder for blocking sliding removal of the valve stem mounting body from within the valve mounting hole of a valve mounting cup.

21. An aerosol valve assembly, comprising:

a valve mounting cup with an open top, and a bottom with a valve mounting hole;

a valve stem mounting member with an intermediate section and a material passageway extending through the intermediate section, said intermediate section being mounted within the valve mounting hole and extending between a valve seat with a valve inlet opening to the material passageway at an underside of the cup, and an annular collar extending outwardly beyond the mounting hole and above the bottom of the cup and surrounding a valve outlet opening from the material passageway, said annular collar being adapted for releasable sealing receipt within a mating dispensing inlet opening of a hollow body of a dispensing actuator;

a valve stem with a body and a valve head; and means for mounting the valve stem to the valve stem mounting member for sliding movement between a closed position in which the valve inlet opening to the passageway is blocked by the valve head, and an open position in which the valve head is spaced from the valve seat to enable entry of material into the valve inlet opening to the passageway.

22. The aerosol valve assembly of claim 21 in which the valve stem mounting means mounts the valve stem for sliding movement within the material passageway.

23. The aerosol valve assembly of claim 21 in which the valve mounting cup has an upstanding annular neck surrounding the mounting hole, and the intermediate section of the valve stem mounting member is snugly held and supported within the annular neck.

24. The aerosol valve assembly of claim 23 in which the annular collar surrounds the upstanding neck and extends outwardly from the intermediate section to define a shoulder, said shoulder overlying the neck and blocking removal of the intermediate section from the neck.

25. The aerosol valve assembly of claim 21 in which the material passageway adjacent the valve outlet opening has an enlarged section that is enlarged relative to the valve stem to facilitate the movement of material past a relatively enlarged actuator engaging end of the valve stem located within the relatively enlarged section.

26. The aerosol valve assembly of claim 21 in which the open top, the bottom and the valve mounting hole are all substantially circular, and the circular bottom is joined to the circular open top by a cylindrical side wall section and a torroidal wall section joining the flat circular bottom to the cylindrical wall, said torroidal wall section extending from adjacent the central circular valve assembly mounting hole to a juncture with the cylindrical wall at a location substantially half the distance between the open top and the substantially flat bottom.

27. The aerosol valve assembly of claim 21 in which the valve mounting cup includes an upstanding valve mounting neck surrounding the central valve mounting hole, said valve mounting neck extending upwardly from the bottom of the cup to a location substantially half the distance between the open top and the bottom.

28. The aerosol valve assembly of claim 21 in which the valve stem has an end opposite the valve head with a recess for receipt of a mating valve actuator member.

29. The aerosol valve assembly of claim 21 in which substantially entire the valve stem body is protectively contained within the material passageway.

30. The aerosol valve assembly of claim 21 in which the valve outlet opening from the material passageway is contained entirely within the valve mounting cup and between the bottom and the top.

31. The aerosol valve assembly of claim 21 in combination with the hollow body of the dispensing actuator, said dispensing inlet opening being in sealed fluid communicating engagement with the valve outlet opening.

32. An aerosol valve assembly, comprising:

a valve body mounted to a valve mounting cup and having a material passageway that extends through the valve mounting cup to a valve outlet opening;

a valve stem assembly with a stem body mounted for sliding movement within the material passageway between an open position and a closed position; and means for connecting the valve outlet opening to a dispensing hollow body.

33. The aerosol valve assembly of claim 32 in which the connecting means includes a resilient collar that surrounds the valve outlet opening for sealed receipt within an inlet end of the dispensing hollow body.

34. The aerosol valve assembly of claim 32 in combination with the dispensing hollow body, said dispensing hollow body having a dispensing inlet end attached to the valve body and surrounding the valve outlet opening.

35. An aerosol valve assembly, comprising:

a valve mounting cup with an open circular top, a substantially flat circular bottom portion surrounding a central, circular, valve assembly mounting hole, a cylindrical side wall, and an arcuate wall section joining the flat circular bottom to the cylindrical side wall and extending from adjacent the flat circular bottom portion to a juncture with the cylindrical wall at a location substantially above the flat bottom portion; and a valve assembly mounted within the central circular valve mounting hole.

36. The aerosol valve assembly of claim 35 in which the valve mounting cup includes an upstanding valve mounting neck surrounding the central circular valve assembly mounting hole and extending upwardly from the bottom of the cup to a location substantially aligned with the juncture.

37. The aerosol valve assembly of claim 36 in which the valve assembly includes a resilient grommet mounted within the central hole having an annular flange with a convex surface extending above and outwardly beyond the neck for releasable frictional mounting of a valve actuator assembly to the neck.

38. The aerosol valve assembly of claim 37 in which the valve assembly includes a movable valve member with an elongate shank with a valve head at one end and an actuator engagement member at another end opposite from the one end for engagement with a mating actuator member of the valve actuator member, said actuator engagement member being located within the grommet adjacent the convex surface of the annular flange.

39. The aerosol valve assembly of claim 38 in which the actuator engagement member has a recess for mating receipt of the mating actuator member.

40. The aerosol valve assembly of claim 35 in which the juncture of the arcuate wall section with the cylindrical side wall is approximately midway between the top and the flat bottom portion.

41. The aerosol valve assembly of claim 35 in which the arcuate wall section has a generally torroidal shape.

42. The aerosol valve assembly of claim 35 including a valve mounting grommet with a substantially flat collar that is pressed against the substantially flat circular bottom.

43. A method of manufacturing an aerosol container containing dispensable material, comprising the steps of:

making a valve mounting cup with a nonpressurized configuration that is distortable to a preselected optimum configuration different from the nonpressurized configuration;

attaching an aerosol valve assembly to a valve mounting cup when in the nonpressurized configuration;

fastening the mounting cup to a pressurizable container;

inserting dispensable and material containing material to be dispensed;

pressurizing the container with a propellant gas until the mounting cup distorts from the nondistorted configuration to the preselected optimum configuration.

44. The manufacturing method of claim 43 in which the mounting cup has a bottom with a central flat portion surrounded by an arcuate portion when in the nondistorted configuration, and at least part of the arcuate portion adjacent the flat portion distorts to a relatively flattened optimum configuration substantially coplaner with the central flat portion during the step of pressurizing.

45. The method of claim 43 in which the mounting cup has an open top and a bottom with a central grommet mounting hole surrounded by an elongate, upstanding neck extending upwardly toward the open top and spaced beneath the open top by a preselected amount when in the nondistorted configuration, and the upstanding neck is moved upwardly to a distorted optimum position spaced beneath the open top by another amount less than the preselected amount during the step of pressurizing.

46. The method of claim 43 in which the mounting cup has an open top and a bottom with a central flat portion spaced from the open top by a preselected amount when in a nondistorted configuration, and the central flat portion of the bottom is moved upwardly toward the open top to an optimum position at which it is spaced from the open top by another amount less than the preselected amount during the step of pressurizing.

47. The method of claim 43 in which the step of pressurizing includes the step of pressurizing the container to a pressure substantially greater than 140 pounds per square inch.

* * * * *